United States Patent [19]

Vance

[11] Patent Number: 4,649,820

[45] Date of Patent: Mar. 17, 1987

[54] HAND HELD IMPACT PRINTER

[76] Inventor: David E. Vance, P.O. Box 21, Cremorne Junction, Sydney, N.S.W., 2090, Australia

[21] Appl. No.: 669,321

[22] Filed: Nov. 7, 1984

[30] Foreign Application Priority Data

| | | | |
|---|---|---|---|
| Jan. 5, 1984 | [AU] | Australia | PG3088 |
| Feb. 1, 1984 | [AU] | Australia | PG3418 |
| Jul. 13, 1984 | [AU] | Australia | PG5998 |

[51] Int. Cl.[4] ..... B41K 1/02

[52] U.S. Cl. ..... 101/327; 101/368

[58] Field of Search ..... 101/3 R, 368, 327, 4, 101/379, 103, 93.02, 93.48, 28; 400/413, 470, 471, 471.1; 401/100; 227/113; 173/90

[56] References Cited

U.S. PATENT DOCUMENTS

| | | | |
|---|---|---|---|
| 1,042,210 | 10/1912 | Ferris | 101/3 R |
| 1,164,086 | 12/1915 | Gooding | 227/113 |
| 1,593,287 | 7/1926 | Card, Jr. | 101/3 R |
| 2,199,265 | 4/1940 | Lohrey | 400/471.1 X |
| 2,382,804 | 8/1945 | Morrison | 101/368 |
| 2,384,707 | 9/1945 | Sweet | 101/3 R X |
| 2,427,358 | 9/1947 | Kovach | 101/3 R |
| 2,455,270 | 11/1948 | Ravella | 101/3 R X |
| 2,558,616 | 6/1951 | Johnson | 101/3 R |
| 2,966,116 | 12/1960 | Harris et al. | 101/368 |
| 3,009,415 | 11/1961 | Harvey | 101/28 X |
| 3,036,482 | 5/1962 | Kenworthy et al. | 173/90 |
| 3,045,593 | 7/1962 | Petterson | 101/368 |
| 3,051,956 | 8/1962 | Theobald | 101/368 X |
| 3,071,994 | 1/1963 | Swenson | 101/3 R X |
| 3,177,952 | 4/1965 | West | 101/3 R X |
| 3,181,626 | 5/1965 | Sussman | 101/3 R X |
| 3,342,128 | 9/1967 | Weitzner | 101/103 |
| 3,362,326 | 1/1968 | Delpo et al. | 101/316 |
| 3,402,663 | 9/1968 | Funabashi | 101/327 |
| 3,468,252 | 9/1969 | Lemelson | 101/379 |
| 3,521,555 | 7/1970 | Price et al. | 101/103 |
| 3,572,591 | 3/1971 | Brown | 101/327 X |
| 3,952,653 | 4/1976 | McFarland | 101/368 X |
| 4,077,319 | 3/1978 | Edmisten | 101/379 X |
| 4,127,063 | 11/1978 | Peterson et al. | 101/3 R |
| 4,207,812 | 6/1980 | Morris | 173/119 X |
| 4,258,623 | 3/1981 | Barrus et al. | 101/93.48 X |
| 4,492,162 | 1/1985 | Nettesheim et al. | 101/103 |

FOREIGN PATENT DOCUMENTS

| | | | |
|---|---|---|---|
| 105033 | 9/1938 | Australia | 101/327 |
| 107705 | 10/1927 | Austria | 101/28 |
| 547390 | 3/1932 | Fed. Rep. of Germany | 101/327 |
| 873844 | 4/1953 | Fed. Rep. of Germany | 101/327 |
| 3233431 | 3/1984 | Fed. Rep. of Germany | 101/379 |
| 476699 | 12/1937 | United Kingdom | 101/327 |

*Primary Examiner*—Clifford D. Crowder

*Attorney, Agent, or Firm*—Cohen, Pontani & Lieberman

[57] ABSTRACT

Several types of hand held printing implements are disclosed for marking characters such as crosses on game coupons such as Lotto and football pools.

The first type prints the character on the top coupon ply and replicates the character on the carbon copy. This type has a hollow tubular body (2,8), a reciprocable printer core (16) inside the body, a print head (15) at the leading end of the core, a spring (30) which stores a print strike force when the body and core slide to a predetermined position and a trip device (34,30) (50,52) (32,62) (66, 74, 76) (96) which fires the core when the print strike force reaches a predetermined magnitude. The print head (15) has a hollow punch part for replicating the character in addition to a part (17) for printing the same. A guide tip (14) enables the user to preposition the print head before printing.

In other versions of this type the print strike force is supplied by a slidable striker (82) or a finger pad (92) operated by the user's finger.

The second type also has a guide tip (14) for prepositioning the print head but merely prints without replicating the character.

14 Claims, 22 Drawing Figures

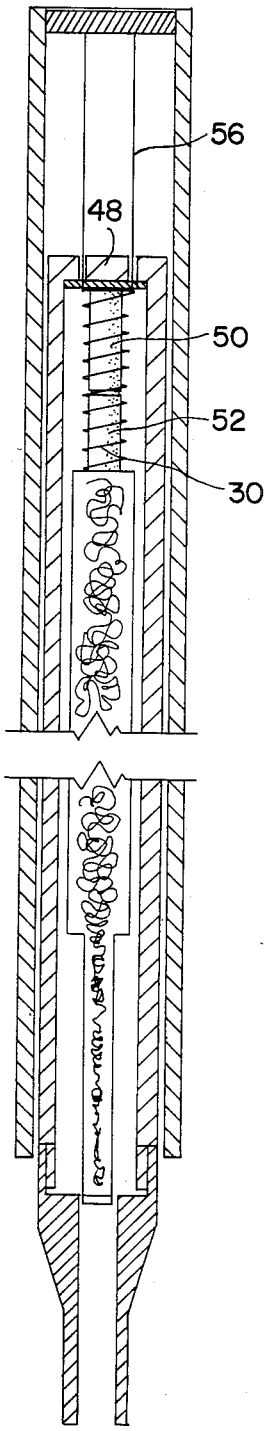
FIG. 4
FIG. 5
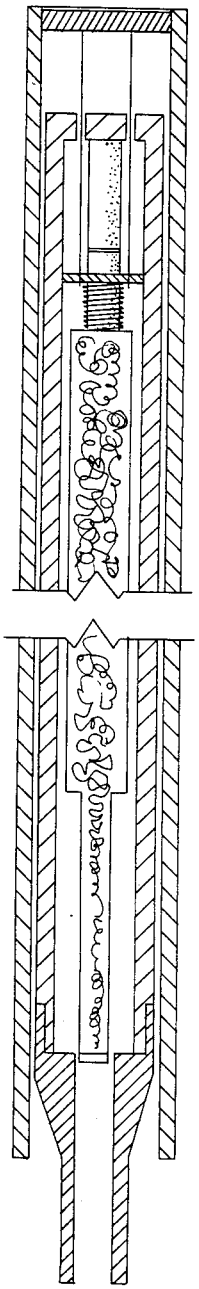
FIG. 6
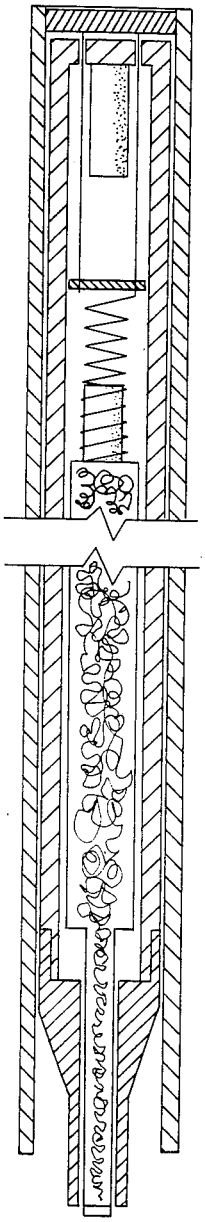

HAND HELD IMPACT PRINTER

FIELD OF THE INVENTION

This invention concerns hand held implements for marking coupons, forms and the like with a repeated character.

BACKGROUND OF THE INVENTION

Certain popular forms of games for example lotto and football pools utilise printed forms which display rectangles which are subdivided into squares. Each player marks a number of squares with a cross or other required character or mark in order to complete an entry but when these are checked by the company who organise the particular form of game, various problems appear. The forms are initially run through an electro-optical reader which is able to read those of the entries which have been marked with some dexterity but is unable to read those entries which have been marked such that a character or mark has been misplaced or not put sufficiently in register with the square which it is supposed to indicate or a part of the cross has extended into an adjacent square or an incorrect colour is used. The electro-optical reader will reject such entries which must then be individually read by eye and a judgement made as to the likely intention of the person who marked the coupon. Such human checking is tedious and expensive to perform. It is rendered necessary because firstly the eyesight, dexterity or patience of the person marking the form is inadequate for the task but secondly a pen is an imprecise instrument for performing the repetitive marking action. Even dextrous, patient writers with good eye sight do not find the application of crosses particularly easy or quick.

A ball point pen is widely used for marking coupons and forms but the need when executing the latter to lift the pen during each marking for example to mark one leg of a cross, lift the pen, re-position, then mark the other leg of the cross leads to big variations even within a small series of entries made by the same person and consequently rejections by the electro-optical reader are frequent.

Somewhat similar problems occur with sheets filled in by persons completing questionnaires, sitting examinations, or conducting surveys where they write a tick in a box or otherwise make repetitive marks perhaps for statistical treatment later. The marks made vary considerably and may prove unreadable when evaluated by a different person.

Thus in this specification the term "character" includes a single stroke, a tick, a cross, a dot, a circle and a numeral.

Entry coupons for Lotto, football pools and the like vary somewhat from country to country. The first type has a top ply, a bottom ply and an intermediate carbon ply. The top ply is the original which is printed by the player and surrendered to the organising company for reading. The intermediate ply has a lower face coated with transfer carbon and the bottom ply is the copy retained by the player. Thus the player must ensure that all marking action is firm enough to transfer the mark clearly through the top layer of the form, through the carbon layer beneath to the bottom layer.

For this first type of form a rubber stamp in a frame with a separate ink pad would render the crosses consistant but the accuracy of register which is necessary and the ability to strike evenly and perhaps to mark a carbon copy beneath the form are beyond the capability of a rubber stamp even if persons could be persuaded to carry about with them a separate ink pad. Self inking stamps suffer from the same disadvantage.

Swiss Pat. No. 362,706 discloses a stamp with a guide frame for ensuring parallelism of print and avoiding smudge.

U.S. Pat. No. 4,205,607 describes a hand labeler with a plier action for advancing a label from a reel and simultaneously printing the same.

Japanese Pat. No. 55-51578 describes an ink immersed stamp which has an inked core which can be pressed against the paper to be printed.

None of these stamps can mark carbon copies simultaneously with the top copy. None have provision for aiming the printing part with sufficient accuracy for printing forms of the type described.

In a second type of form for other games the entry forms are not carbon backed but the player must print a series of crosses into a number of small squares for that part of the form which is surrendered to the company. Then the player must manually duplicate those crosses or characters to that part of the entry form which the player retains as a receipt. In some other types of the games the player places a series of vertical lines within a number of small squares with the same requirements as to colour and register.

In both these examples no replication by carbon backing is required yet these remain tedious and subject to error. This invention in its simplest form seeks to be useful for these types of games wherein the ability to preposition the cross or character would be very useful.

Several versions of the invention are set forth varying in complexity. One form of the invention provides a hand held printing implement for simultaneously marking at least two superimposed paper plies with a character, which implement has a print head having a printing part which defines a character to be printed, an ink supply to the printing part to permit the character to be printed when the head contacts the paper ply, and a punch part which also defines the character and allows the user to replicate the character on a copy ply beneath the printed ply by the application of suitable pressure.

Another form of the invention provides a hand held printing implement for simultaneously marking at least two superimposed paper plies with a character comprising:

a printer core having a leading end and an opposite end;

a print head at the leading end, the print head having a printing part to permit the character to be printed when the head contacts the paper ply and a punch part which also defines the character and allows the user to replicate the character on a copy ply beneath the printed ply; and a striker which slides on the printer core and strikes the printer core in order to simultaneously print and replicate the character.

A further form of the invention provides a hand held printing implement for simultaneously marking at least two superimposed paper plies with a character comprising:

a hollow tubular body;

a printer core having a leading end and an opposite end, nested in the body, the body and core being slidable in relation to each other;

a print head at the leading end of the core;

bias means arranged to bias the printer core toward the leading end of the body; and means extending from the core outside the body to permit the user's finger to flip the core against the bias means to generate a print strike force.

A still further form of the invention provides a hand held printing implement for simultaneously marking at least two superimposed paper plies with a character comprising:

a hollow tubular body;

a printer core having a leading end and an opposite end, nested in the body, the body and core being slidable in relation to each other;

a print head at the leading end of the core;

bias means capable of storing a print strike force for imposition on the core when the body and core slide in relation to each other; and trip means operable when the body and core slide to a predetermined position to release the print strike force suddenly when the force reaches a predetermined magnitude, causing the printing head to strike the plies.

The body may comprise a static inner tube which accommodates the core, the inner tube having a guide end for contacting the ply to be printed and a reaction end; and an outer reciprocable tube which moves between a loaded position in which the bias means is loaded against the core and a rest position in which the bias means is less loaded. The printing head may be a hollow punch which defines the perimeter of the character to be printed. The space within the perimeter may be filled with an ink impregnated pad. Alternatively the hollow punch may be a capillatory orifice. The pad or orifice may be in flow communication with an ink reservoir in the core. The ink may be mobile, for example aqueous ink, volatile ink or viscous for example thixatropic ink such as used in ball point pens. The guide end of the static inner tube may have an axial tubular guide ending in a tip which projects beyond the outer reciprocable tube in order that the tip is located accurately on the ply over the site to be printed, and the leading end of the core has a neck which is a slide fit in the axial guide. Conveniently the bias means is a coli spring acting between the core and the outer reciprocable tube.

The trip means may be a two part magnetic coupling, one part being connected to the opposite end of the core, the other part being connected to the static inner tube, the parts of the coupling being normally in contact except when the outer reciprocable tube slides loading the bias means to a predetermined position whereupon the parts separate and the core is fired axially toward the ply. Thus in one version of the implement the outer tube may have an open end and a closed end, the reaction end of the static inner tube holds one part of the magnetic coupling and defines a pair of apertures close to the periphery of the part of the magnetic coupling; a pair of push-rods extend from the closed end of the outer tube through the apertures and support an annular spring pad which is coaxial with the said part of the coupling and is capable of urging a coil spring against the core when the outer tube slides in relation to the inner tube. The guide end of the static inner tube may have an axial tubular guide ending in a tip which projects beyond the outer reciprocable tube in order that the tip is locatable accurately on the ply over the site to be printed and the leading end of the core, said tubular guide having a lead in, and the leading end of the core has a nozzle which is a running fit in the lead in and a slide fit in the axial guide.

In another version of the implement the core is a running fit inside the static inner tube and has at the opposite end:

(a) a lip which normally engages a stop on the opposite end of the inner static tube; and (b) a ramp face capable of engaging the outer tube such that when the outer tube slides towards the ply to be printed the ramp face tilts the core and lip out of engagement with the inner static tube causing the core to fire under the action of the bias means.

The opposite end of the core may be open giving access to a spring pocket inside the core which pocket contains a coil spring; a pendant finger extends from the closed end of the reciprocable tube into the open end of the core in order to compress the spring when the reciprocable tube is slid toward the ply, said finger being itself captive within the spring pocket in order to retract the core when the reciprocable tube retracts to the rest position. Thus the pendant finger may have a captive end and a free end, a spring contacting pad at the free end for location within a spring pocket and a mount at the captive end which is supported by the closed end of the outer tube and which permits precissional movement of the free end of the pendant finger. The core may be a loose fit inside the inner static tube and the ramp face is located on a portion of the pendant finger.

DESCRIPTION OF THE DRAWINGS

FIG. 4 is a sectional side elevation of a magnetic version of the invention also in the rest position;

FIG. 5 is the same view as FIG. 4 but in the loaded position just prior to firing the core;

FIG. 6 is the same view as FIG. 4 but with the core in the print position;

DESCRIPTION OF THE EMBODIMENTS

Figure 1:
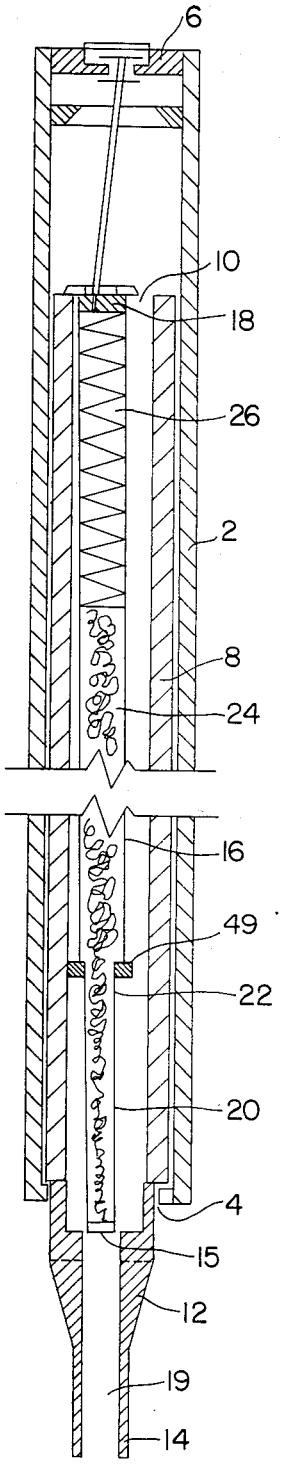
FIG. 1 is a sectional side elevation of the non-magnetic embodiment in the rest position.

Referring firstly to FIGS. 1 to 3 and 7 the implement is almost the same size as a felt tip pen. It is substantially cylindrical being 135 mm long and 10.5 mm in diameter. A cap (not shown) is provided to keep the ink wet.

An outer tube 2 has an open end 4 and a closed end 6. Nested within the outer tube 2 is a shorter static inner tube 8 with an open end 10 and a guide end 12. The outer tube 2 is a free slide fit on the inner tube 8. The open end of the outer tube has a lipped mouth which retains the inner tube 8. The guide end 12 terminates in a square sectioned hollow pointer 14.

The core 16 is a loose fit within the static inner tube and is about equal in length to the static inner tube. The core 16 has a reaction end 18 and a printing head end 20 which is a slide fit in the passage 19 of the guide end 12 of the static inner tube. The printing head is made of metal or plastic and terminates in a hollow cruciform configuration 15 (best seen in FIG. 7) which defines the perimeter of the area within the perimeter being filled with ink conducting fibres 17 and connected by a neck 22 to an ink reservoir 24 which occupies part of the core. The remainder of the core constitutes a spring pocket 26.

Figure 2:
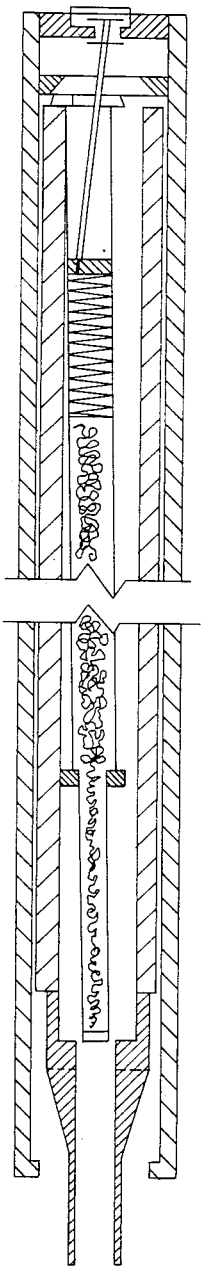
FIG. 2 is the same view as FIG. 1 but in the loaded position just prior to firing the core.
Figure 3:
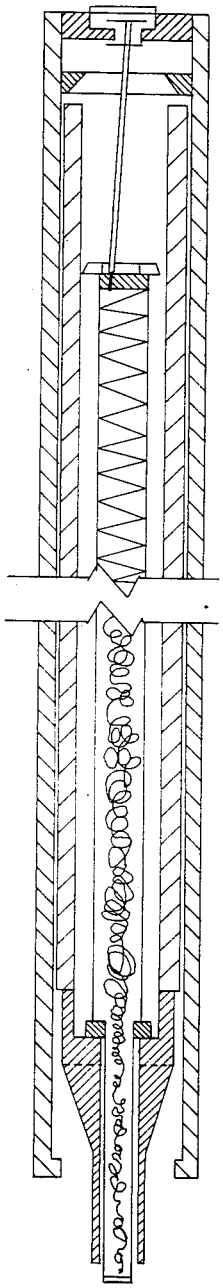
FIG. 3 is the same view as FIG. 1 but with the core in the print position.
Figure 11:
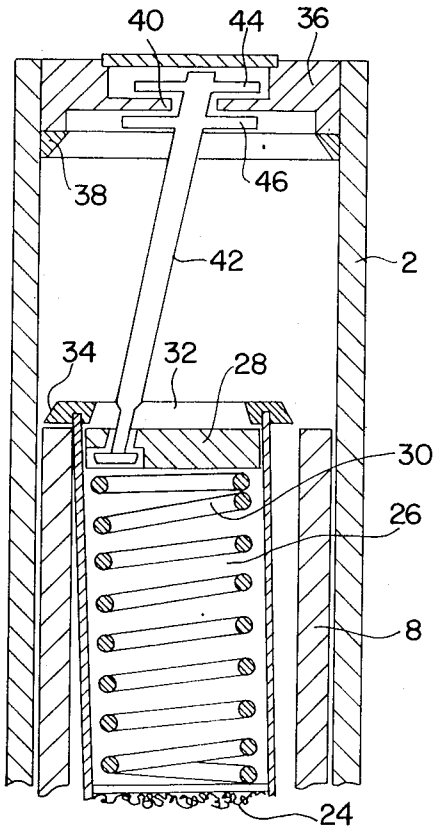
FIG. 11 is a large scale fragmentary view of the non-magnetic version.

Referring now to FIG. 11 the pocket 26 is closed by a spring pad 28 which traps a coil spring 30 against the end of the reservoir 24. The pad 28 is retained by a lip 32 with an outer bevel 34 formed on the reaction end of the core which is intended to overlie the open end of the static inner tube when the core is caused to ride up inside the static inner tube and reach a loaded position as shown in FIGS. 2 and 3.

The closed end of the outer tube 2 has a moulded cap 36 with a bevel 38 complementary to the bevel 34 on the lip 32. The cap has an aperture 40 which acts as a mount for one end of a pendant finger 42 rendered captive in the mount by a pair of flanges 44, 46. The opposite end is connected to the spring pad 28 but is free to rotate and precess due to its off centre connection with the spring pad 28.

The device works as follows. FIG. 1 shows the parts of the implement at rest. The user places the pointer 14 exactly over the square on a LOTTO form. Registration is easy because the cross-section of the pointer and square are equal in size. The print head is clear of the LOTTO form at this time. The implement is loaded by pressing the outer tube 2 downwardly. The finger 42 compresses the coil spring and the core retains its inclined attitude within the inner static tube allowing the lip 32 to rest on the open end of the static inner tube. When the position of FIG. 2 is reached the bevel 38 near the end cap collides with the bevel 34 on the lip and the core is fired towards the form which it is intended to print.

The print head prints and transfers a carbon image of the head to the paper layer beneath. Foam washer 49 absorbs bounce.

The outer tube is lifted upwardly after firing to reassume the start position enabling the process to be repeated.

Referring now to FIGS. 4 to 6 and 12, the outer reciprocable tube 2, static inner tube 8, core 16 and spring 30 are all present but this embodiment differs only in that it is tripped to fire by the separation of a magnetic coupling.

The static inner tube is closed by an end wall 48. The end wall supports a cylindrical magnet 50. A cylindrical keeper 52 is fixed to the reaction end of the core. Spring 30 surrounds both magnet and keeper.

End wall 48 has a pair of bores 54 through which a pair of pushrods 56 extend. The pushrods are fixed to the closed end of the outer reciprocable tube and serve to support an annular spring pad 58 within spring pocket 26.

The device works as follows. FIG. 4 shows the parts at rest. The pointer 14 is placed on a square to be marked as before. The outer tube is pressed downwardly in order to compress the spring against the attraction of the magnet and keeper. When the position at FIG. 5 is reached, the magnet and keeper separate allowing the core to be fired toward the form to be printed.

Figure 13:
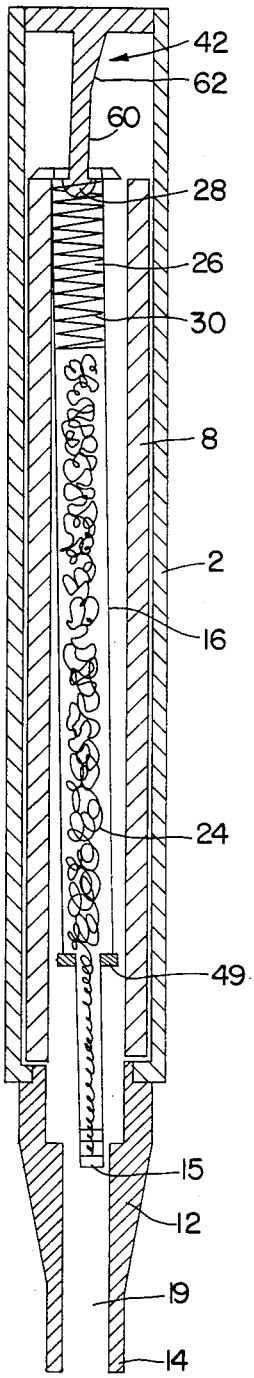
FIG. 13 is a sectional elevation of a variation of the non-magnetic version shown in FIGS. 1 to 3.
Figure 7:
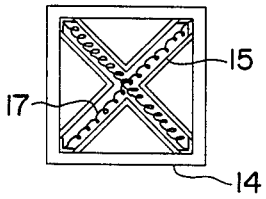
FIG. 7 is an end view of the print head.
Figure 8:
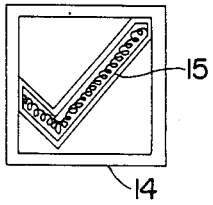
FIGS. 8 to 10 show end views of various print head configurations.
Figure 9:
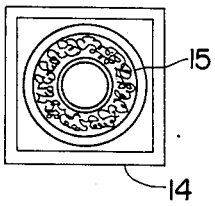
Figure 10:
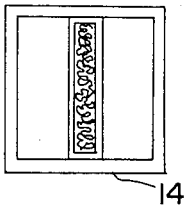

In FIG. 13 the pendant finger 42 has a parallel sided portion 60 and a ramp portion 62. When the outer tube is depressed the ramp portion eventually projects into the mouth of the core displacing the latter to a central position which trips and fires the core. The spring pad 28 in this version is hemispherical and must be of precise shape and size in order to reciprocate smoothly in the core.

Figure 14:
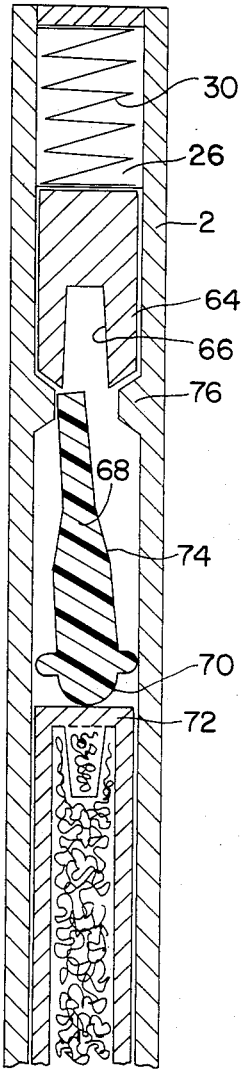
FIG. 14 is a sectional elevation of a further variation of the non-magnetic version also shown in the rest position.
Figure 15:
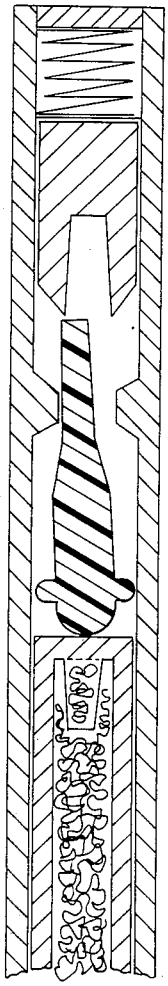
FIG. 15 is the same view as FIG. 14 but in the loaded position just prior to firing.
Figure 16:
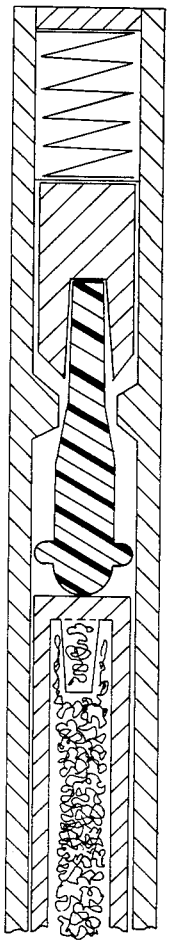
FIG. 16 is the same view as FIG. 14 but with the core in the print position.
Figure 17:
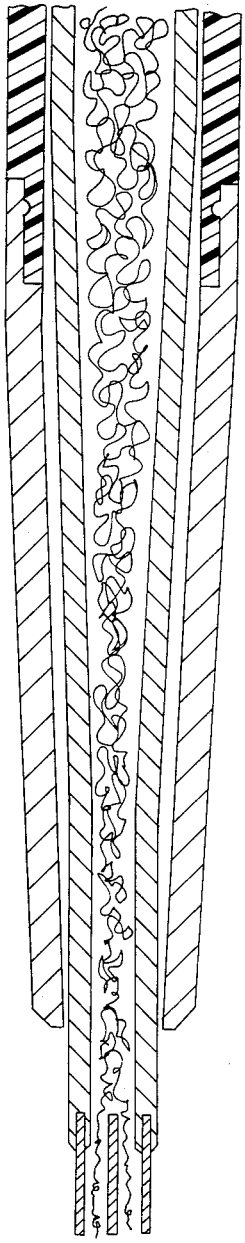
FIG. 17 is a fragmentary view of the printing end of some versions of the implement.

In FIGS. 14 to 16 the implement is made with fewer parts and the trip is somewhat different in operation. The coil spring 30 biasses a piston 64 containing a tapered bore 66. Striker 68 ends in a dome 70 which contacts a cap 72 fixed to the closed end of the core. The striker has a tapered neck 74. Bevelled internal flange 76 projects from the internal surface of outer reciprocable tube 2 and restricts angular displacement of the striker. When the outer tube is depressed the piston obstructs the striker and causes the coil spring 30 to be compressed. When the flange 76 meets the tapered neck 74, the striker and the bore 66 move into register and the piston trips and fires as shown in FIG. 16.

Figure 18:
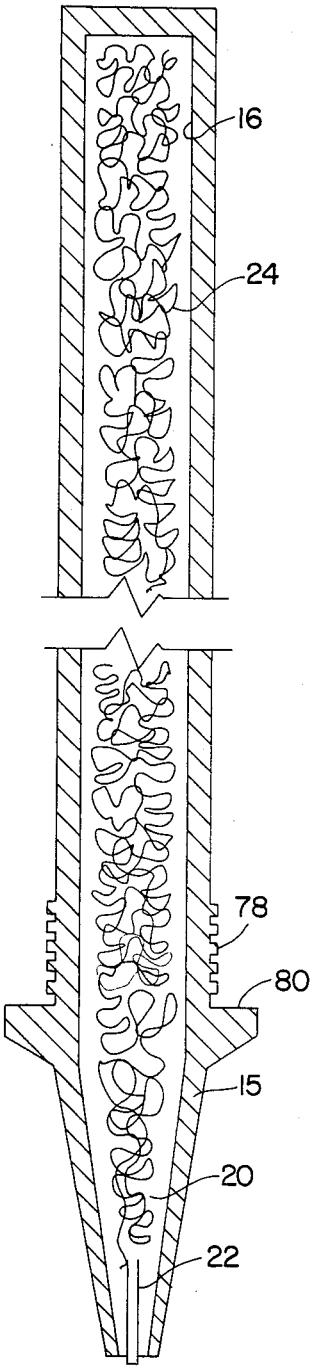
FIG. 18 is a sectional elevation of an embodiment without moving parts.

Referring now to FIG. 18, the core 16 has a printing head end 20 which terminates in the hollow cruciform configuration described in relation to FIGS. 1 to 3. The area within the perimeter is connected by neck 22 to liquid ink reservoir 24. Core 16 has a knurled portion 78 and flange 80 against which the fingers of the user are pressed in order to apply the requisite pressure to replicate the character.

This version marks the top ply immediately as the print head touches the paper which therefore precludes prepositioning without printing as in the more complex versions described above but has the virtue of simplicity.

Figure 19:
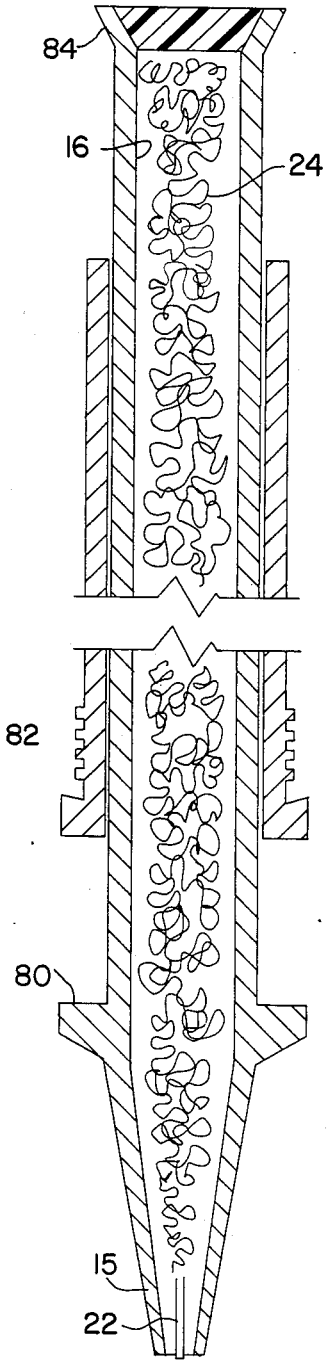
FIG. 19 is a sectional elevation of an embodiment showing an external striker.

Referring now to FIG. 19 the same core 16 is present but the flange 80 acts as an anvil which is struck by a coaxial striker sleeve 82. The opposite end 84 of the core is flared after assembly to render the striker captive on the core.

Figure 20:
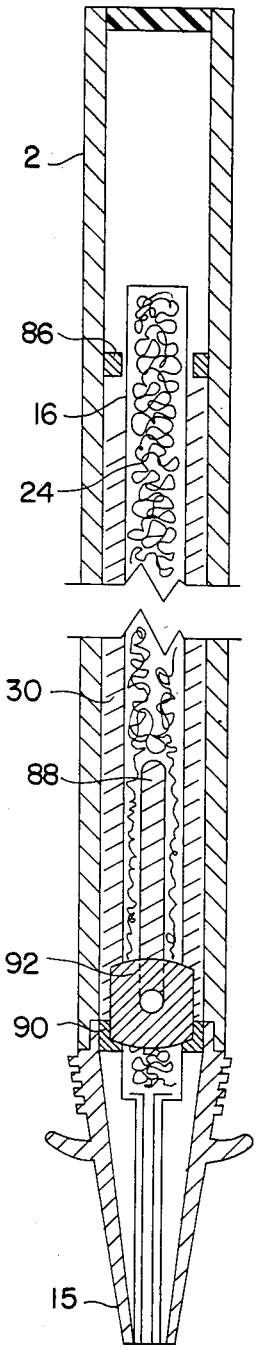
FIG. 20 is a sectional elevation of an embodiment showing provision for digital operation of the printer core.

Referring now to FIG. 20 the tube 2 is longer than the core 16 which it contains. The tube 2 has an internal stop 86 and an axial slot 88. The core has a collar 90 which supports a finger pad 92. The latter extends through the axial slot 88 to lie partly outside the tube 2. A coil spring 30 is trapped between collar 90 and stop 86.

The device works as follows. The user prepositions the pointer 14 on the square to be printed. The print head is kept just out of contact with the paper by a foam washer (not shown). The finger pad 92 allows the user to lift the core against spring pressure allowing it to snap back and both print and replicate the character simultaneously.

Figure 21:
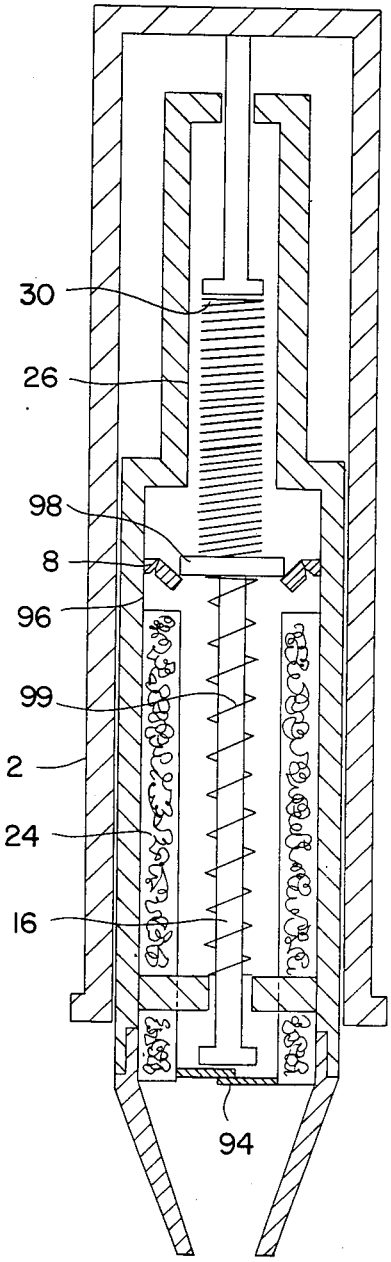
FIG. 21 is a sectional elevation of an embodiment showing the print head wiping structure.

Referring now to FIG. 21 the outer tube 2 surrounds the static inner tube 8 which contains print core 16. The ink reservoir 24 of the core is sleeve-shaped with an array of wiper fibres 94 located in the path of the print head. The required print strike force is generated by depressing spring 30 until the annular bistable stop 96 flexes to allow spring pad 98 to pass. Return spring 99 drives pad 98 past the stop 96 on the return stroke.

Figure 22:
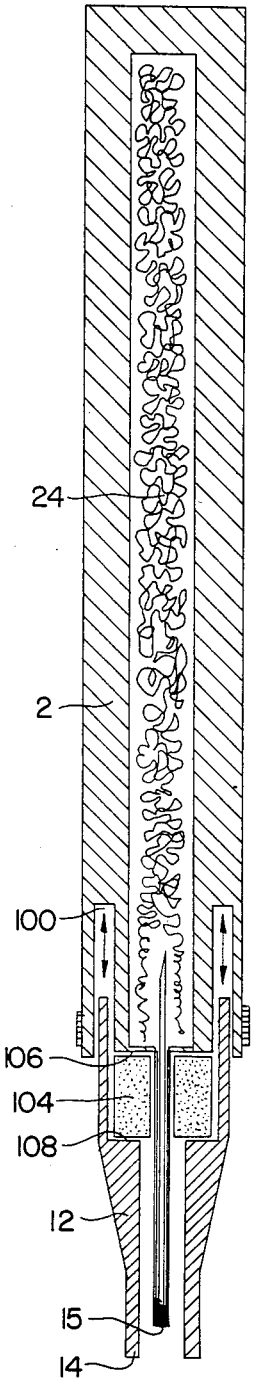
FIG. 22 is a sectional elevation of an embodiment which allows print head prepositioning but not character replication.
Figure 12:
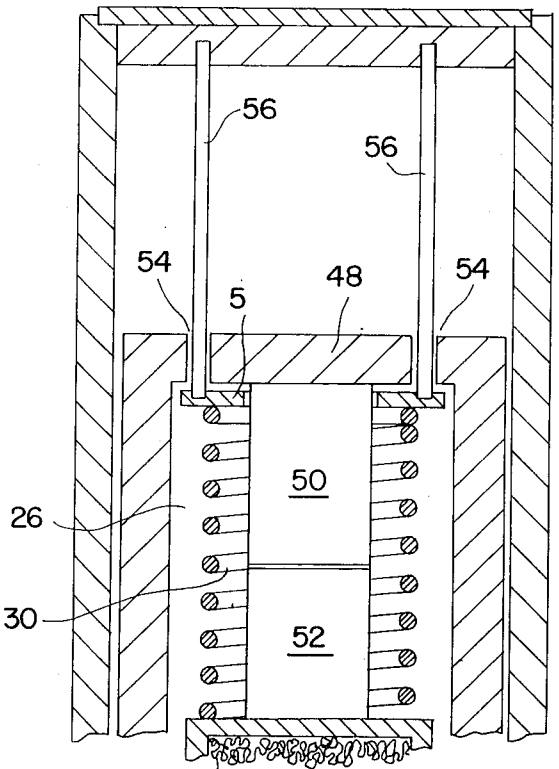
FIG. 12 is a large scale fragmentary view of the magnetic version.

Referring now to FIG. 22, outer tube 2 and pointer 14 coaxially overlap and slide in relation to each other by the provision of recess 100. The neck 22 which carries the print head projects into pointer 14 but remains clear of the paper to be printed by the inclusion of foam washer 104 between shoulder 106 and shoulder 108. The print head merely prints and is intended for games where replication of the character is not required.

The cores of the various versions may be exchangeable for a refill as for example in a ball point pen. Provision for exchange of cores is easy. The guide 12 is a push fit on the end of the static inner tube.

The implement may be made of either plastic mouldings, plastic extrusion, thin sheel metal tubes or extruded metal parts depending upon the quality and finish which is desired.

I claim:

1. A hand held printing implement for marking at least one paper ply with a character, comprising:

a hollow tubular body;

a printer core having a leading end and an opposite end, nested in the body, the body and core being slidable in relation to each other;

an ink reservoir within the core;

a retractable print head at the leading end of the core;

the print head having a character formed as a rigid hollow punch, the punch portion being formed by protrusions defining the perimeters of the hollow portion, the protrusions extending in the direction of the print strike motion, each protrusion having at one end thereof a ply striking surface essentially perpendicular to the print strike motion, the hollow portion forming essentially the same character as the punch portion;

ink transfer means in said hollow portion and communicating with said ink reservoir for transferring the ink to said print head;

said hollow portion being substantially unobstructed for unobstructed contact between said ink transfer means in said hollow portion and said paper ply surface for impressing a continuous character on said surface;

bias means capable of storing a print strike force for imposition on the core when the body and core slide in relation to each other; and trip means operable when the body and core slide to a predetermined position to release the print strike force suddenly when the force reaches a predetermined magnitude causing the printing head to strike the ply.

2. The printing implement of claim 1, wherein the core is removable to facilitate the use of refill cartridges and wherein the core comprises:

(a) a leading end and an opposite end;

(b) a print head at the leading end, the print head having a printing part to permit the character to be printed when the head contacts the paper ply, and a punch part which also defines the character and allows the user to replicate the character on a copy beneath the printed ply; and (c) an ink reservoir for supplying the printing part.

3. A hand held printing implement as claimed in claim 1 wherein the body comprises a static inner tube which accommodates the core, the inner tube having a guide end for contacting the ply to be printed and a reaction end; and an outer reciprocable tube which moves between a loaded position in which the bias means is loaded against the core and a rest position in which the bias means is less loaded.

4. A hand held printing implement as claimed in claim 3 wherein the guide end of the static inner tube has an axial tubular guide ending in a tip which projects beyond the outer reciprocable tube in order that the tip is locatable accurately on the ply over the site to be printed, and the leading end of the core has a neck which is a slide fit in the axial guide.

5. A hand held printing implement as claimed in claim 4 wherein the bias means is a coil spring acting between the core and the outer reciprocable tube.

6. A hand held printing implement as claimed in claim 4 characterised in that the core is a running fit inside the static inner tube and has at the opposite end:

(a) a lip whereas the outer tube interior has a guide and at least one of these has a ramp face; and (b) whereby when the outer tube slides towards the ply to be printed the ramp face tilts the core and lip out of engagement with the inner static tube causing the core to fire under the action of the bias means.

7. A hand held printing implement as claimed in claim 3 wherein the trip means is a two part magnetic coupling one part being connected to the opposite end of the core the other part being connected to the static inner tube, the parts of the coupling being normally in contact except when the outer reciprocable tube slides loading the bias means to a predetermined position whereupon the parts separate and the core is fired axially toward the ply.

8. A hand held printing implement as claimed in claim 3 characterised in that the print head is a hollow punch which defines the perimeter of the character to be printed, the space within the perimeter of the punch being a capillary orifice which is supplied with ink from a reservoir in the core.

9. A hand held printing implement as claimed in claim 1 wherein the bias means is a spring and the trip means includes a striker which drives the core and a hammer which drives the striker under the influence of the spring, the striker and hammber being normally out of register until moved into register by sliding motion of the body in relation to the core whereupon the spring loaded hammer is released.

10. A hand held printing implement as claimed in claim 1 wherein the trip means is a stop which arrests the core while the requisite print strike force grows and suddenly flexes in order to fire the core.

11. A hand held printing implement for marking at least one paper ply with a character, comprising:

a hollow tubular body;

a printer core having a leading end and an opposite end, nested in the body, the body and the core being slidable in relation to each other;

a print head at the leading end of the core;

bias means capable of storing a print strike force for imposition on the core when the body and core slide in relation to each other;

trip means operable when the body and core slide to a predetermined position to release the print strike force suddenly when the force reaches a predetermined magnitude causing the printing head to strike the ply; the body comprising a static inner tube which accommodates the core, the inner tube having a guide end for contacting the ply to be printed and a reaction end; and an outer reciprocable tube which moves between a loaded position in which the bias means is loaded against the core and a rest position in which the bias means is less loaded; the trip means being a two-part magnetic coupling, one part being connected to the opposite end of the core, the other part being connected to the static inner tube, the parts of the coupling being normally in contact except when the outer reciprocable tube slides loading the bias means to a predetermined position whereupon the parts separate and the core is fired axially toward the ply, the outer tube having an open end and a closed end, the reaction end of the static inner tube holding one part of the magnetic coupling and defining a pair of aperture close to the periphery of the one part of the magnetic coupling; a pushrod extending from the closed end of the outer tube through the aperture and supporting an annular spring pad which is coaxial with the said part of the coupling and being capable of urging a spring against the core when the outer tube slides in relation to the inner tube.

12. A hand held printing implement for marking at least one paper ply with a character, comprising:

a hollow tubular body;

a printer core having a leading end and an opposite end, nested in the body, the body and the core being slidable in relation to each other;

a print head at the leading end of the core;

bias means capable of storing a print strike force for imposition on the core when the body and the core slide in relation to each other; and trip means operable when the body and the core slide to a predetermined position to release the print strike force suddenly when the force reaches a predetermined magnitude causing the printing head to strike the ply;

the body comprising a static inner tube which accommodates the core, the inner tube having a guide end for contacting the ply to be printed and a reaction end; and an outer reciprocable tube which moves between a loaded position in which the bias means is loaded against the core and a rest position in which the bias means is less loaded;

the guide end of the static inner tube having an axial tubular guide ending in a tip which projects beyond the outer reciprocable tube in order that the tip is locatable accurately on the ply over the side to be printed and the leading end of the core having a neck which is a slide fit in the axial guide;

the core being a running fit inside the static inner tube and having at the opposite end: (a) a lip whereas the outer tube interior has a guide and at least one of these has a ramp face; and (b) whereby the outer tube slides towards the ply to be printed the ramp face tilts the core and lip out of the engagement with the inner static tube causing the core to fire under the action of the bias means;

the opposite end of the core being open giving access to a spring pocket inside the core which pocket contains a spring; a pendant finger extending from the end of the reciprocable tube into the open end of the core in order to compress the spring when the reciprocable tube is slid toward the ply, said finger being itself captive within the spring pocket in order to retract the core when the reciprocable tube retracts to the rest position.

13. A hand held printing implement for marking at least one paper ply with a character, comprising:

a hollow tubular body;

a printer core having a leading end and an opposite end, nested in the body, the body and the core being slidable in relation to each other;

a print head at the leading end of the core;

bias means capable of storing a print strike force for imposition on the core when the body and the core slide in relation to each other; and trip means operable when the body and the core slide to a predetermined position to release the print strike force suddenly when the force reaches a predetermined magnitude causing the printing head to strike the ply;

the body comprising a static inner tube which accommodates the core, the inner tube having a guide end for contacting the ply to be printed and a reaction end; and an outer reciprocable tube which moves between a loaded position in which the bias means is loaded against the core and a rest position in which the bias means is less loaded;

the guide end of the static inner tube having an axial tubular guide ending in a tip which projects beyond the outer reciprocable tube in order that the tip is locatable accurately on the ply over the site to be printed and the leading end of the core having a neck which is a slide fit in the axial guide;

the core being a running fit inside the static inner tube and having at the opposite end: (a) a lip whereas the outer tube interior has a guide and at least one of these has a ramp face; and (b) whereby the outer tube slides towards the ply to be printed the ramp face tilts the core and lip out of the engagement with the inner static tube causing the core to fire under the action of the bias means;

the opposite end of the core being open giving access to a spring pocket inside the core which pocket contains a spring; a pendant finger extending from the end of the reciprocable tube into the open end of the core in order to compress the spring when the reciprocable tube is slid toward the ply, said finger being itself captive within the spring pocket in order to retract the core when the reciprocable tube retracts to the rest position;

the pendant finger having a captive end and a free end, a spring contacting pad at the free end for location within the spring pocket and a mount at the captive end which is supported by the closed end of the outer tube and which permits precessional movement of the free end of the pendant finger.

14. A hand held printing implement for marking at least one paper ply with a character, comprising:

a hollow tubular body;

a printer core having a leading end and an opposite end, nested in the body, the body and the core being slidable in relation to each other;

a print head at the leading end of the core;

bias means capable of storing a print strike force for imposition on the core when the body and the core slide in relation to each other; and trip means operable when the body and the core slide to a predetermined position to release the print strike force suddenly when the force reaches a predetermined magnitude causing the printing head to strike the ply;

the body comprising a static inner tube which accommodates the core, the inner core having a guide end for contacting the ply to be printed and a reaction end; and an outer reciprocable tube which moves between a loaded position in which the bias means is loaded against the core and a rest position in which the bias means is less loaded;

the guide end of the static inner tube having an axial tubular guide ending in a tip which projects beyond the outer reciprocable tube in order that the tip is locatable accurately on the ply over the site to be printed and the leading end of the core having a neck which is a slide fit in the axial guide;

the core being a running fit inside the static inner tube and having at the opposite end; (a) a lip whereas the outer tube interior has a guide and at least one of these has a ramp face; and (b) whereby the outer tube slides towards the ply to be printed the ramp face tilts the core and lip out of the engagement with the inner static tube causing the core to fire under the action of the bias means;

the opposite end of the core being open giving access to a spring pocket inside the core which pocket contains a spring; a pendant finger extending from the end of the reciprocable tube into the open end of the core in order to compress the spring when the reciprocable tube is slid toward the ply, said finger being itself captive within the spring pocket in order to retract the core when the reciprocable tube retracts to the rest position;

the pendant finger having a captive end and a free end, a spring contacting pad at the free end for location within the spring pocket and a mount at the captive end which is supported by the closed end of the outer tube and which permits precessional movement of the free end of the pendant finger;

the core being a loose fit inside the inner static tube and the ramp face being located on a portion of the pendant finger.

* * * * *